US005985528A

United States Patent [19]

Komamura et al.

[11] Patent Number: 5,985,528

[45] Date of Patent: Nov. 16, 1999

[54] RESOURCES RECOVERY METHOD IN A SILVER SALT PHOTOGRAPHIC SYSTEM

[75] Inventors: Tawara Komamura; Shinri Tanaka; Michiko Nagato; Hiroyuki Iizuka; Noritaka Nakayama; Naoshi Kunieda; Hideaki Haraga, all of Hino, Japan

[73] Assignee: Konica Corporation, Tokyo, Japan

[21] Appl. No.: 09/109,057

[22] Filed: Jul. 2, 1998

[30] Foreign Application Priority Data

Jul. 2, 1997 [JP] Japan ..... 9-193060

[51] Int. Cl.[6] ..... G03C 5/31

[52] U.S. Cl. ..... 430/398; 430/399

[58] Field of Search ..... 430/357, 380, 430/399, 398

[56] References Cited

U.S. PATENT DOCUMENTS

| | | | |
|---|---|---|---|
| 3,400,046 | 9/1968 | Hills | 376/405 |
| 3,840,455 | 10/1974 | Cooley et al. | 204/269 |
| 3,964,990 | 6/1976 | Woyden | 204/228.2 |
| 4,069,127 | 1/1978 | Salemi et al. | 204/228.2 |
| 5,210,009 | 5/1993 | McGuckin et al. | 430/399 |
| 5,698,379 | 12/1997 | Bohan et al. | 430/359 |
| 5,756,269 | 5/1998 | Ishikawa et al. | 430/351 |

*Primary Examiner*—Hoa Van Le

*Attorney, Agent, or Firm*—Finnegan, Henderson, Farabow, Garrett & Dunner, L.L.P.

[57] ABSTRACT

A method to recover the resources incorporated in a photographic material is disclosed. An exposed silver salt light-sensitive photographic material is subjected to color development processing; the obtained image information is optically read; digital image information is obtained by converting the read information to electrical signals, and the resulting image information is recorded on a recording medium, and resources incorporated in a photographic material is recovered from the processed photographic material.

8 Claims, 1 Drawing Sheet

RESOURCES RECOVERY METHOD IN A SILVER SALT PHOTOGRAPHIC SYSTEM

FIELD OF THE INVENTION

The present invention relates to a method to recover resources in a silver salt photographic system.

BACKGROUND OF THE INVENTION

The photographic system employing optical cameras, which has been widely carried out, is a system composed of a series of processes such that the photographer captures images employing a camera loaded with a silver halide light-sensitive photographic material; at a photofinisher, according to the photographer's request, the exposed silver halide light-sensitive photographic material is subjected to negative film processing including development, bleaching and fixing, or bleach-fixing, washing or stabilizing process, substituting washing, drying; printing exposure is carried out; the exposed color paper is subjected to paper processing such as development, bleach and fixing or bleach-fixing, washing or stabilizing process, substituting washing; negative materials and positive pictures (prints) are then delivered to the photographer, and the like.

Contrary to the above system, a photographic system, which is the current in recent years, is one not employing silver halide light-sensitive photographic materials, in which an image captured by a so-called electronic camera is converted into electrical digital signals and recorded, and a positive image is formed employing the recorded digital signals.

The photographic system employing the optical camera enables the production of clear images having excellent sharpness, and the low expenditure as exemplified by single-use cameras. On the other hand, the photographic system employing digital cameras needs a fairly expensive electronic camera, and enables the immediate visualization of recorded images through inputting the image signals to a microcomputer without the need of processing such as development, etc., the electrical transmission of images, and the like.

Comparison of both systems in terms of effective utilization of resources reveals that in the system employing the conventional optical camera, negative filmstrips are returned to the photographer; in most cases, they are simply retained and no attempt is made for the recovery of resources because unwanted negative filmstrips are usually thrown away together with other waste; in film processing such as development, etc., silver incorporated in silver halide light-sensitive photographic materials is dissolved into processing solutions during a desilvering process, e.g. bleaching or bleach-fixing; furthermore, because the process solution waste is generally treated by special contracted finishers, resources are not recovered and expense is needed to treat the solution waste contained in a large volume of water. Compared to the above facts, in the photographic system employing the electronic camera, no silver salts are employed and the silver recovery process itself is immaterial so that there is no solution waste. Thus, the system employing the electronic camera is markedly advantageous in terms of saving and recovery of the resources.

Furthermore, in recent years, issues of environmental protection and decrease in consumption of silver resources have become increasingly important, and development of methods to reduce environmental pollution and to efficiently separate or recover silver has been much in demand.

In the conventional system in which a silver halide light-sensitive photographic material is subjected to developing, bleaching, and fixing, the major silver resources exist in the fixing solution and smaller amounts exist individually in the washing water, rinsing solution, developing solution, etc. Conventionally, problems have been that in order to recover the silver resources, these solution wastes, comprising a large volume of valueless water, have been pumped into tanks and transported, resulting in increased transportation cost and processes to handle the solution wastes, comprising removable chemicals. Apparatuses to concentrate the solution waste have been developed and the above-mentioned problems have been somewhat minimized. However, there have still been problems of increased cost due to the expensive concentrating apparatus and power required to concentrate the waste.

As mentioned above, the conventional system is accompanied with several difficulties for the recovery of silver resources, and a system which effectively and readily recovers resources from photographic materials has been increasingly sought.

Japanese Patent Publication Open to Public Inspection No. 9-146247 discloses a system in which a silver halide light-sensitive photographic material is not subjected to a desilvering process but is subjected to image information reading, and then image printing onto another recording medium. However, the object of this technique is to obtain digital data and prints and no resources recovery is described. Furthermore, every example describes exposure onto color paper employing negative filmstrips, and return of the negative filmstrips to the photographer is premised.

In order to recover resources from silver halide light-sensitive materials, the present invention is to provide an effective and easy method to recover resources without returning any processed negative filmstrips.

SUMMARY OF THE INVENTION

An object of the present invention is to provide a method to feasibly save and recover resources, and an image-forming system and an image-forming method. Another object of the present invention is to enable the reduction in cost of the whole system.

The recovering method of the invention and its embodiment are described.

A method to recover resources incorporated in a photographic material which comprises processing an exposed silver salt light-sensitive photographic material by color development processing; reading the obtained image information by optically reading means; obtaining digital image information by converting the read information to electrical signals; recording the digital image information on a recording medium; and recovering resources from processed photographic material.

A method to recover resources comprising silver halide incorporated in a silver halide light-sensitive photographic material.

A method to recover resources in which the photographic process is a dye image-forming process and the removal of light-sensitive compositions and photographically processed matter is not accompanied.

A method to recover resources in which a photographic process is a thermal photographic process.

A method to recover resources in which silver is recovered from the light-sensitive material subjected to a photographic process.

A method to recover resources in which the transportation of silver-comprising resources to a silver-recovering facility is carried out without configuration change of image-capturing photographic materials.

A method to recover resources in which silver recovery is carried out from processed photographic materials and the supports of the photographic materials are recycled.

Japanese Patent Publication Open to Public Inspection No. 9-146247 describes a method in which digital data are obtained by reading a scanned image, while keeping silver formed by the photographic process. According to the description, due to the premise that color paper is employed for printing in the same manner as in the prior art, color negative filmstrips are returned to the photographer without fail for possible reprinting in the future. Accordingly, the above invention is different from the present one in which the object is to contribute to resources recovery through the recovery of color negative filmstrips.

DESCRIPTION OF THE INVENTION

Figure 1:
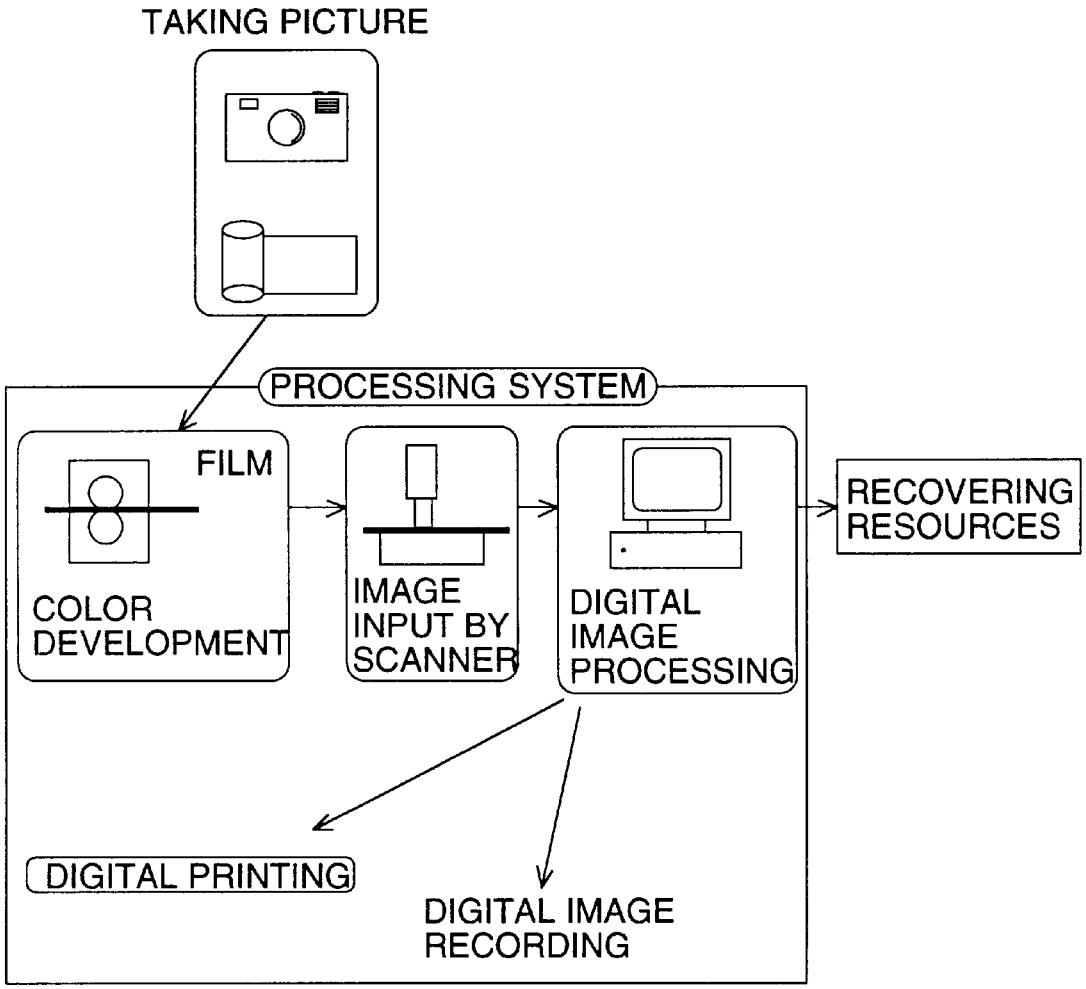
FIG. 1 is a diagram showing the image-forming system according to the present invention.

The present invention is specifically described below.

In the present invention, resources recovery and resources reutilization are considered for three aspects of image-capturing employing a camera, photographic processing, and image storage.

During image capture with a camera, conventional optical cameras may be employed. There is no need to purchase an expensive camera which is employed for the photographic system utilizing a digital camera, because common optical cameras such as single-use cameras, compact cameras, single reflex cameras, etc. may be employed as they are.

In conventional optical cameras, conventional silver halide light-sensitive photographic materials are employed as they are. In addition, it enables less expensive light-sensitive photographic materials through improvements in processing.

In the conventional photographic system, without returning photographed and processed filmstrips to the photographers, which had commonly been returned to them, light-sensitive material manufacturers can recover used filmstrips in the most convenient configuration for recycling. For example, in silver halide light-sensitive photographic materials comprising PET film as the support, an exposed film is subjected to photographic processing, and after the resulting images are read and stored, the filmstrips may be immediately put into a recycling process. Thus, recovery cost can be remarkably decreased due to the simplification of the recovering operation channel, simplification of pre-treatment processes, etc. The light-sensitive material manufactures then enjoy benefits such as, needless to mention, production of recycled products employing recovered materials, and supply them as materials for other industrial use.

In the aspect of processing, resources recovery and resources reutilization are carried out as mentioned below. In the conventional photographic system, filmstrips subjected to processing such as development, etc. are returned to the photographer to meet the assumed requirement for reprinting. Thus, processed filmstrips were required to be stored by the photographer. Accordingly, in order to make the processed filmstrip durable for storage, bleaching and fixing, or bleach-fixing, washing or stabilizing process substituting washing, drying, etc. were required. This method is not advantageous for the resources recovery and reutilization. The first problem is an increase in cost due to the requirement for a large investment for facilities caused by a plurality of processing steps and required accuracy, and in addition, the need for trained expert operators. The second problem relates to the treatment of the resulting photographic solution waste.

In the present invention, as one method to solve this problem, a conversion method of image information to a signal recording medium is accepted. As a preferred method, a thermal development method may be employed. A color image as information is obtained on a filmstrip, and this image information is read and converted by a scanner to digital information, which can then be recorded into a signal recording medium.

In this case, only thermal development is carried out and bleaching or bleach-fixing process is eliminated, which is employed as the conventional desilvering process. Thus, silver halide slats remain on the emulsion support (filmstrip). These remaining silver halide salts can be removed by, for example, immersing the filmstrip into a sodium hypochloride solution and peeling off the silver halide emulsion layer itself. By this method, silver recovery is efficiently and readily carried out and no concern is necessary for environmental issue regarding the treatment of photographic waste, comprising a large volume of water. This method is extremely advantageous in an environment-oriented society.

When the thermal development method is employed, light-sensitive photographic material known conventionally in the art may be employed without any special limitation.

On the other hand, when conventional silver halide light-sensitive photographic materials are employed as film for image-capturing, those known conventionally in the art may be employed without any limitation. In this case, as the photographic process, for example, a wet type development process is only carried out and the following desilvering processes are deleted. As available developer compositions, etc., those conventionally used are employed without any limitation.

The representative example of the image-forming method employed in the present invention is as follows.

An image-forming method is that on a support, at least, light-sensitive silver halide, a binder, and a dye-forming coupler are placed; a light-sensitive material comprising at least three types of light-sensitive layers in which spectrally sensitized regions and hues of dyes formed by the above-mentioned dye-forming couplers are different from each other is subjected to image exposure and development processing; after forming at least three color images, without removing any remaining silver halide and developed silver, the resulting image information is converted to optical information or electrical information, and based on the information, a color image is formed on a recording material. The support of the light-sensitive material is preferably a transparent support. At maximum absorption wavelengths of three color dyes formed by dye-forming couplers through development, the transparent densities of the light-sensitive material are preferably Dmin of 2.0 or less, Dmax of 4.0 or less, and Dmax−Dmin of 1.0 or more.

Furthermore, an image-forming method is also preferred, in that, on the support, at least, light-sensitive silver halide, a binder, a dye-forming coupler, and a developing agent to form a dye upon reacting with this dye-forming coupler are placed; a light-sensitive material comprising at least three types of light-sensitive layers in which spectrally sensitized regions and hues of dyes formed by the above-mentioned dye-forming couplers are different from each other is subjected to image exposure and development processing; after forming at least three color images, without removing any remaining silver halide and developed silver, the resulting image information is converted to optical information or electrical information, and based on the information, a color image is preferably formed on a recording material. In this case, the support of the light-sensitive material is preferably a transparent support, and at maximum absorption wavelengths of three color dyes formed by dye-forming couplers through development, the transparent densities of the light-sensitive material are preferably Dmin of 2.0 or less, Dmax of 4.0 or less, and Dmax—Dmin of 1.0 or more.

On the other hand, an image-forming method is preferred in that, on the support, at least, light-sensitive silver halide, a binder, a dye-forming coupler, and a developing agent to form a dye upon reacting with this dye-forming coupler are placed; a light-sensitive material comprising at least three types of light-sensitive layers in which spectrally sensitized regions and hues of dyes formed by the above-mentioned dye-forming couplers are different from each other is subjected to image exposure and development processing after forming at least three color images, without removing any remaining silver halide and developed silver, the resulting image information is converted to optical information or electrical information, and based on the information, a color image is preferably formed on a recording material. In this case, a thermal development method is particularly preferred in which development processing temperatures are in the range of 60 to 150° C.

In the foregoing, the light-sensitive material is most preferably a material for image-capturing comprising a transparent support as the support.

In the method in which a conventional silver halide light-sensitive photographic material is employed and a wet-type development process is carried out, because a desilvering process, that is, bleaching or bleach-fixing process, is not carried out, photographic solution waste is extremely easily treated resulting in advantage to an environment-oriented society. By, after the development process, carrying out a fixing process without a bleaching process, scanning accuracy is occasionally improved.

Image information, read by a scanner, is subjected to noise elimination process, etc. employing an image-processing device, and is then stored in so-called recording media such as CD-R, MO, etc., which are available for printing, electrical transmission, etc.

In the case of converting the color image on a light-sensitive photographic material into digital image information, for example, an advantage is exhibited in which an image is obtained which is clearer than that obtained with digital image information employing a digital camera by employing a method in which an enlarged projected image is reduced upon converting to digital image information.

The present invention is explained with reference to FIG. 1.

A development process is preferably composed of a process in which a container holding an exposed light-sensitive photographic material, such as a single-use camera and a cartridge, is inserted into a device having a development processing section; a process in which the light-sensitive photographic material is removed from the container; and a process in which the light-sensitive photographic material is developed. The image information converting process is composed of a process in which the image information of the developed light-sensitive photographic material is optically read by a scanner, etc. and a process in which the read information is converted to electrical signals and a conversion process in which only necessary information data are retrieved. The converted information signal data preferably are digital signal data. A recovery process may include a process in which the developed light-sensitive photographic material, which has been read, is subjected to configuration for easy transportation in such a way that it is wound on rolls, etc. A recording process includes a process in which data obtained by the converting process is recorded onto portable recording media such as a hard disk, MO, CD, etc. Furthermore, in the process, information may be transmitted via telephone lines, etc., and then recorded.

In order to carry out silver recovery from a photographic material subjected to development process, for example, the photographic material is subjected to a desilvering process, etc. and s solution containing a soluble silver salt is prepared, from which silver is separated or recovered.

As a method to separate or recover silver from the soluble silver salt-containing solution mentioned above, a means known in the art is employed without any special limitation. Namely, for example:

(1) a method in which a base metal having greater ionization tendency than silver is placed in contact with the solution, which replaces the dissolved silver (2) an electrolysis method in which silver is deposited onto a cathode Silver recovery methods employing electrolysis are described in Japanese Patent Publication Open to Public Inspection Nos. 50-98837, 52-26315, 52-115723, 53-32869, and 53-60391; West German Patent Nos. 2,333,018 and 2,429,288; Belgian Patent No. 780,623; and U.S. Pat. Nos. 3,400,056, 3,840,455, 3,964,990, and 4,069,127. Methods described in those patents include an electrolysis method in which a reducing agent is added while varying potential, a method employing a membrane, an electrodialysis method, a method automatically controlling electric current, techniques relating to improvements in such as liquid transport, stirring method, or devices such as an electrode or an electrode plate, etc.

Silver recovery methods other than those mentioned above include a method employing a basic ion exchange resin, described in, for example, Japanese Patent Publication Open to Public Inspection Nos. 49-70823 and 51-17114; DT 2630661, DL 130180, etc.

In addition to those mentioned above, which can be effectively utilized are, for example, an electrolysis method (described in French Patent No. 2,299,667), a precipitation method (described in Japanese Patent Publication Open to Public Inspection No. 52-73037 and German Patent No. 2,331,220), an ion exchange method (described in German Patent No. 2,548,237), and a metal replacement method (described in U.K. Patent No. 1,353,805).

In the ion exchange method, as one means of silver recovery, ion exchange resins, which are preferably employed, are those in which a functional group is combined with a polymer base subjected to three dimensional polycondensation, and anion exchange resins. The polymer bases include, for example, styrene-divinylbenzene copolymers, methacrylate- or acrylate-divinylbenzene copolymers, phenol-formalin resins, etc. Functional groups include a quaternary ammonium group, having a primary to tertiary amine structure, an imidodiacetic acid type, a polyamine type, an amidoxim type, an aminophosphoric acid type, and a dithiocarbamine type in chelate resins.

The above-mentioned ion exchange resins are commercially available under names such as Diaion manufactured by Mitsubishi Kagaku Corp., Amberrite manufactured by Organo Corp., Duorite and Sumikaion manufactured by Sumitomo Kagaku Kogyo Co., etc.

Specific examples of the above-mentioned anion exchange resins are illustrated.

(1) Strong Basic Anion Exchange Resins for example, Mitsubishi Diaion SA-10A, SA-11A, PA-308 SA-20A, SA-21A, PA-408

(2) Weak Basic Ion Exchange Resins for example, Mitsubishi Diaion WA-10, WA-11, WA-20, WA-21, WA-30

Anion substituents of these basic ion exchange resins are preferably $OH^-$, $Cl^-$, $SO_4^{2-}$, $Br^-$, $COOH^-$, $CO_3^{2-}$, and $SO_3^{2-}$.

Of the above-mentioned anion exchange resins, those which are most preferably employed are weak basic ion exchange resins.

EXAMPLES

Example 1

(Comparison with Conventional Silver Halide Light-sensitive Photographic Material)

((Preparation of Thermal Development Light-sensitive Material))

On a polyethylene naphthalate support (thickness of 90 μm), a gelatin subbing layer of 0.1 μm thickness was applied and on the resulting, constituting layers mentioned below were coated to form Thermal Development Light-sensitive Material 101. The added amount of each material is herein shown in terms of the amount per $m^2$ and the added amount of the light-sensitive silver halide emulsion is shown in terms of silver.

| | |
|---|---|
| First Layer (red-sensitive layer) | |
| Alkali process gelatin (Ca content: 90 μg/g gelatin) | 0.18 g |
| Phenylcarbamoyl gelatin (Ca content: 50 μg/g gelatin) | 0.55 g |
| Red-sensitive silver halide emulsion (EM-1) | 0.7 mmol |
| Cyan coupler C-1 | 191 mg |
| Developing agent-1 | 256 mg |
| Silver behenate | 0.90 mmol |
| Surface active agent-1 | 0.082 g |
| High-boiling point organic solvent-1 | 0.59 g |
| Thermal solvent-1 | 0.20 g |
| Antifoggant-1 | 0.43 mg |
| Potassium bromide | 0.13 mg |
| Second Layer (first interlayer) | |
| Alkali process gelatin (Ca content: 90 μg/g gelatin) | 0.24 g |
| Phenylcarbamoyl gelatin (Ca content: 50 μg/g gelatin) | 0.51 g |
| Surface active agent-1 | 0.07 g |
| High-boiling point organic solvent-1 | 0.33 g |
| Polyethyleneimine | 0.1 g |
| Third Layer (green-sensitive layer) | |
| Alkali process gelatin (Ca content: 90 μg/g gelatin) | 0.228 g |
| Phenylcarbamoyl gelatin (Ca content: 50 μg/g gelatin) | 0.58 g |
| Green-sensitive silver halide emulsion (EM-2) | 0.925 mmol |
| Magenta coupler M-1 | 210 mg |
| Developing agent-1 | 256 mg |
| Silver behenate | 0.90 mmol |
| Surface active agent-1 | 0.071 g |
| High-boiling point organic solvent-1 | 0.52 g |

-continued

| | |
|---|---|
| Thermal solvent-1 | 0.20 g |
| Fourth Layer (second interlayer) | |
| Alkali process gelatin (Ca content: 90 μg/g gelatin) | 0.24 g |
| Phenylcarbamoyl gelatin (Ca content: 50 μg/g gelatin) | 0.51 g |
| Surface active agent-1 | 0.07 g |
| High-boiling point organic solvent-1 | 0.30 g |
| Fifth Layer (blue-sensitive layer) | |
| Alkali process gelatin (Ca content: 90 μg/g gelatin) | 0.08 g |
| Phenylcarbamoyl gelatin (Ca content: 50 μg/g gelatin) | 0.31 g |
| Blue-sensitive silver halide emulsion (EM-3) | 0.39 mmol |
| Yellow coupler Y-1 | 195 mg |
| Developing agent-1 | 256 mg |
| Silver behenate | 0.90 mmol |
| Surface active agent-1 | 0.023 g |
| High-boiling point organic solvent-1 | 0.52 g |
| Thermal solvent-1 | 0.20 g |
| Sixth Layer (protective layer) | |
| Alkali process gelatin (Ca content: 90 μg/gelatin) | 0.29 g |
| Phenylcarbamoyl gelatin (Ca content: 50 μg/g gelatin) | 0.21 g |
| Reducing agent-1 | 0.06 g |
| Surface active agent-1 | 0.06 g |
| High-boiling point organic solvent-1 | 0.30 g |
| Matting agent (silica: average particle diameter 3 μm) | 0.01 g |
| Hardening agent-1 | 0.15 g |

Further, in the First, Third and Fifth Layers, each developing agent was emulsified/dispersed in an aqueous gelatin solution in the presence of the surface active agent-1 along with the high-boiling point organic solvent, and the resulting dispersion was added.

After the above-mentioned emulsified dispersion is prepared, ethyl acetate, employed as a dispersing aid, was removed under reduced pressure. The content ratio of the total of the ethyl acetate and methanol, employed to dissolve various additives, was not more than 2 percent in each coating composition.

Each light-sensitive silver halide emulsion employed is shown below.

Each silver halide emulsion was prepared by covering silver iodobromide grains with silver bromide. The average of the above grains was 0.18 μm in a silver iodobromide emulsion (the content ratio of silver iodide was 2 mole percent) through the addition of an aqueous silver nitrate solution and an aqueous potassium bromide solution to the above emulsion, employing a double-jet mixing. Further, when the grain surface grew by a thickness of 0.05 μm after the mixing, $10^{-6}$ mole of iridium hexachloride (IV) per mole of silver halide was added to each emulsion. Water-soluble salts were removed employing a method commonly known in the art and silver halide emulsions having characteristics shown in Table 1 were prepared.

TABLE 1

| | Em-1 | EM-2 | EM-3 |
|---|---|---|---|
| Silver Halide Composition | AgBr99.9/0.1 | AgBr99.8/0.2 | AgBr99.8/0.2 |
| Average Grain Diameter | 0.50 μm | 0.41 μm | 0.41 μm |
| Crystal Shape | tabular crystal | tabular crystal | tabular crystal |

TABLE 1-continued

| | Em-1 | EM-2 | EM-3 |
|---|---|---|---|
| Grain Diameter Distribution | monodisperse | monodisperse | monodisperse |
| Chemical Sensitizer | ST: 0.02 mg | ST: 0.02 mg | ST: 0.02 mg |
| Sensitizing Dye | SD-1:7 mg<br>SD-2:20 mg<br>SD-3:12 mg | SD-4:12 mg<br>SD-5:12 mg | SD-7:6 mg<br>SD-6:20 mg |
| Stabilizer | ST-1:600 mg | ST-1:600 mg | ST-1:600 mg |

Structural formulas of employed additives are shown below.

The resulting thermal development light-sensitive material was wound on rolls; was stored at conditions of a relative humidity of 30 to 50 percent and a temperature of 23° C. for two days; was further stored at conditions of a relative humidity of 30 to 60 percent and a temperature of 35° C. for 6 days, and was then hardened.

SD-1

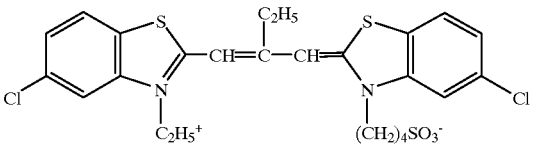

SD-2

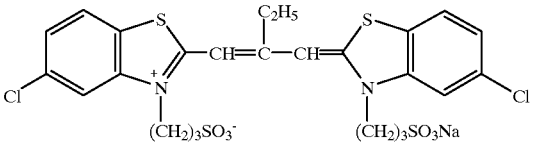

SD-3

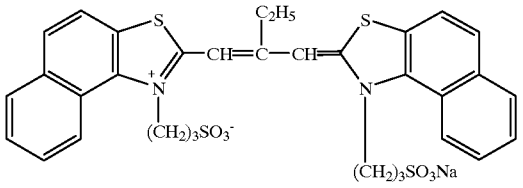

SD-4

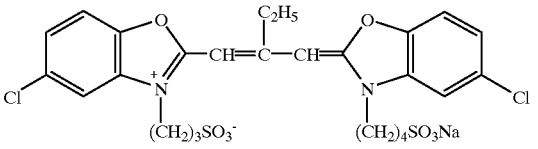

SD-5

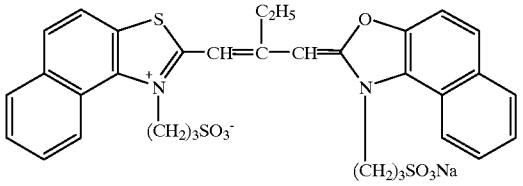

SD-6

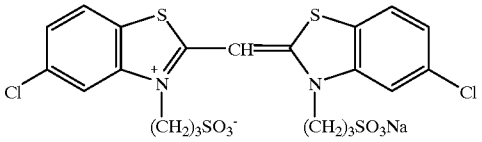

-continued

SD-7

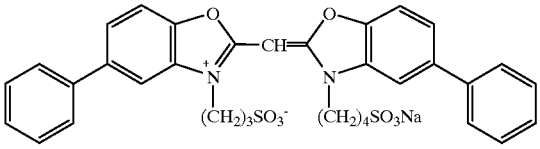

Compounds Employed in the Example

Reducing Agent-1:

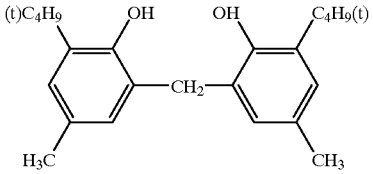

Antifoggant:

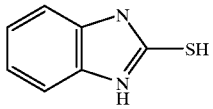

Chemical Sensitizer (ST): sodium thiosulfate
Stabilizer (ST-1): phenylmercaptotetrazole Developing Agent-1

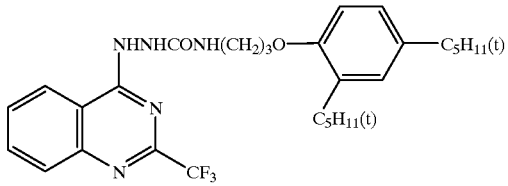

Cyan Coupler C-1

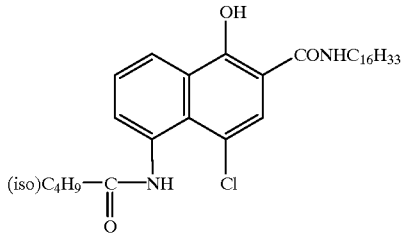

Magenta Coupler M-1:

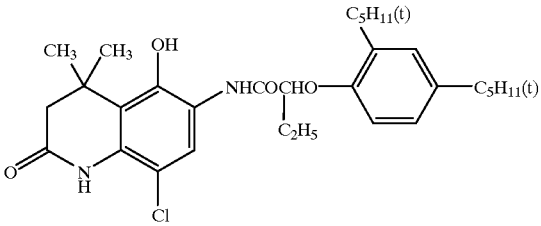

Yellow Coupler Y-1:

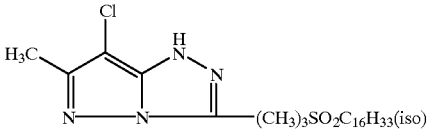

Surface Active Agent-1: sodium dodecylbenzene sulfonate
High-boiling Point Organic Solvent-1: tricresyl phosphate -continued Thermal solvent-1:

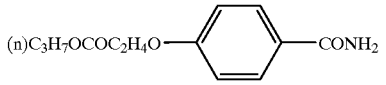

Hardener-1:

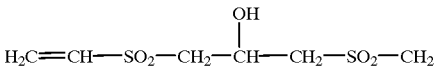

Sample 101 prepared by the above-mentioned method was exposed imagewise and was then thermally developed by heating for 30 seconds employing a 120° C. heated roller.

Comparative Sample 102 was processed employing recording processing solutions mentioned below. Development time was 3 minutes and 15 seconds; bleaching time and fixing time each was 45 seconds; stabilizing time was 60 seconds, and drying time was 60 seconds.

(Processing Step)

TABLE 2

| PROCESSING STEP | PROCESSING TIME | PROCESSING TEMPERATURE (° C.) | REPLENISHMENT RATE (ml) |
|---|---|---|---|
| Color Development | 3 minutes 15 seconds | 38 ± 0.3 | 780 |
| Bleaching | 45 seconds | 38 ± 2.0 | 150 |
| Fixing | 1 minute 30 seconds | 38 ± 2.0 | 830 |
| Stabilizing | 60 seconds | 38 ± 5.0 | 830 |
| Drying | 1 minute | 38 ± 5.0 | — |

Note: replenishment rate is based on the amount per $m^2$ of light-sensitive photographic material.

The following color developer, bleach, fixer, stabilizer, and replenisher of each were employed.

| Color Developer | |
|---|---|
| Water | 800 ml |
| Potassium carbonate | 30 g |
| Sodium hydrogencarbonate | 2.5 g |
| Potassium sulfite | 3.0 g |
| Sodium bromide | 1.3 g |
| Potassium iodide | 1.2 mg |
| Hydroxylamine sulfate salt | 2.5 g |
| Sodium chloride | 0.6 g |
| 4-Amino-3-methyl-N-ethyl-N-(β-hydroxyethyl)aniline sulfate salt | 4.5 g |
| Diethylenetriaminepentaacetic acid | 3.0 g |
| Potassium hydroxide | 1.2 g |
| Water to make | 1 liter |

The pH was adjusted to 10.06 employing potassium hydroxide or 20% sulfuric acid.

| Color Developer Replenisher | |
|---|---|
| Water | 800 ml |
| Potassium carbonate | 35 g |
| Sodium hydrogencarbonate | 3 g |
| Potassium sulfite | 5 g |
| Sodium bromide | 0.4 g |
| Hydroxylamine sulfate salt | 3.1 g |
| 4-Amino-3-methyl-N-ethyl-N-(β3-hydroxyethyl)aniline sulfate salt | 6.3 g |
| Potassium hydroxide | 2 g |
| Diethylenetriaminepentaacetic acid | 3.0 g |
| Water to make | 1 liter |

The pH was adjusted to 10.18 employing potassium hydroxide or 20% sulfuric acid.

| Bleaching Solution | |
|---|---|
| Water | 700 ml |
| Ammonium ferric 1,3-diaminopropane-tetraacetate | 125 g |
| Ethylenediaminetetraacetic acid | 2 g |
| Sodium nitrate | 40 g |
| Ammonium bromide | 150 g |
| Glacial acetic acid | 40 g |
| Water to make | 1 liter |

The pH was adjusted to 4.4 employing ammonia water or glacial acetic acid.

| Bleach Solution Replenisher | |
|---|---|
| Water | 700 ml |
| Ammonium ferric 1,3-diaminopropane-tetraacetate | 175 g |
| Ethylenediaminetetraacetic acid | 2 g |
| Sodium nitrate | 50 g |
| Ammonium bromide | 200 g |
| Glacial acetic acid | 56 g |

The pH was adjusted to 4.0 employing ammonia water or glacial acetic acid, and water was then added to make 1 liter.

| Fixer | |
|---|---|
| Water | 800 ml |
| Ammonium thiocyante | 120 g |
| Ammonium thiosulfate | 150 g |
| Sodium sulfite | 15 g |
| Ethylenediaminetetraacetic acid | 2 g |

The pH was adjusted to 6.2 employing glacial acetic acid or ammonia water, and water was then added to make 1 liter.

| Fixer Replenisher | |
|---|---|
| Water | 800 ml |
| Ammonium thiocyante | 150 g |
| Ammonium thiosulfate | 180 g |
| Sodium sulfite | 20 g |
| Ethylenediaminetetraacetic acid | 2 g |

The pH was adjusted to 6.5 employing glacial acetic acid or ammonia water, and water was then added to make 1 liter.

| Stabilizer and Stabilizer Replenisher | |
|---|---|
| Water | 900 ml |
| $p\text{-}C_8H_{17}\text{-}C_6H_4\text{-}O\text{-}(CH_2CH_2O)_{10}H$ | 2.0 g |
| Dimethylolurea | 0.5 g |
| Hexamethylenetetraamine | 0.2 g |
| 1,2-benzisothiazoline-3-on | 0.1 g |
| Siloxane (L-77 manufactured by UCC) | 0.1 g |
| Ammonia water | 0.5 ml |
| Water to make | 1 liter |

The pH was adjusted to 8.5 by employing ammonia water or 50% sulfuric acid.

Sample 101 of the present invention and Comparative Sample 102 each was read by an Image Scanner Q-Scan manufactured by Konica Corp.; the resulting data were transmitted to a Personal Computer PC-9821V7 manufactured by NEC Corp.; were then processed (gradation and color tone were automatically corrected) employing a Photo Shop manufactured by Adobe Co., and were then outputted onto Photo Jet Paper manufactured by Konica Corp. employing a Printer MJ-910 manufactured by Seiko Epson Co.

Sample 101 of the present invention resulted in production of clear prints, excellent in graininess and gradation in the same manner as for Comparative Sample 102.

Sample 101 of the present invention took 30 seconds for negative film processing, while Comparative Sample 102 took 5 minutes and 15 seconds. The present invention definitely exhibits advantages in terms of possible rapid processing and no formation of processing waste.

Example 2

(Adaptability to the Environment)

Thermally developed Sample 101 prepared in Example 101 was bleach-processed employing the bleaching solution used in Example 1; was then immersed in a 5% sodium hypochloride and the emulsion layer was peeled off. The silver concentration in the solution was 35 g/liter which was greater than 7 g/liter in the processing solution waste, produced by the conventional system, and exhibited the advantage of silver recovery. When the remaining support was washed, the resulting support was found to be PET, having sufficient purity enabling the same to be supplied as raw materials for photographic support. Thus, the support can be recovered and recycled, which, in the conventional system, the recovery was impossible because filmstrips were returned to customers.

Furthermore, in the system of the present invention, negative filmstrips recovered at shops can be conveyed to processing facilities, as they are. Thus, the present invention is clearly more advantageous, in terms of cost reduction and energy savings, than the conventional system, in which processing solution waste containing a large volume of valueless water is conveyed. The present system also exhibits the advantage in that there is no limitation on the conveyance means, such as special vehicles.

Example 3

(Comparison with Conventional Digital Camera)

A Macbeth Chart and a human subject were photographed employing a Digital Camera Q-EZ manufactured by Konica Corp.; the resulting image data were transmitted to a Power Macintosh 7500/100 manufactured by Macintosh Co.; were processed (automatic correction of gradation and color tone) employing a Photo Shop manufactured by Adobe Co., and were then outputted to a Printer MJ-910C manufactured by Seiko Epson Co. Outputted images, along with Samples prepared in Example 1 and the Macbeth Chart were shown to 10 monitors and were subjected to subjective evaluation. Image gradation, quality difference (the reproduced human subject looks as real as a human being or as a window dummy, and the like), and color reproduction were evaluated. When each of the properties was evaluated to be acceptable by no more than 6 people, a "poor" evaluation was marked; when each was evaluated to be acceptable by 7 or 8 people, it was evaluated as "good", and when each was evaluated to be acceptable by 9 or 10 people, "excellent" was the evaluation. The above results are shown in Table 3.

TABLE 3

| Sample Number | Gradation | Appearance Quality | Color Reproduction |
|---|---|---|---|
| 101 (Present Invention) | Excellent | Excellent | Excellent |
| 102 (Comparative Example) | Good | Poor | Good |

The comparative outputted image was not preferable which exhibited low color purity in the reproduced Macbeth Chart and mixed color impression compared with the print prepared in Example 1. In the scene, in which the human subject was photographed, the comparative outputted image exhibited awkward notches in the contours, no detailed reproduction of high-lighted portions such as the forehead, etc. due to poor gradation, and, in addition, no reproduction of quality impression for human skin, cloth of the suit, etc. The present invention clearly exhibits an advantage in terms of the image quality.

According to the above evaluation results, it is clear that the image formed by Sample prepared by the image-forming method of the present invention is remarkably superior to the image which is photographed by a digital camera, and outputted.

Example 4

(Use of Internet)

The image stored in the Personal Computer PC-9821V7 manufactured by NEC Corp. in Example 1 was transmitted to another Personal Computer PC-9821V7 manufactured by NEC Corp. via Internet and was printed in the same manner as for Example 1. The resulting print was excellent in image quality, similar to Example 1, and was preferable. According to this result, it is confirmed that it is possible to instantly transmit the image data from the location where the image was developed to a remote location.

When the system of the present invention and the image-forming method are employed, it is possible to simply and quickly provide quality image information and to contribute to resources savings and environmental protection.

According to the present invention, the recovery of photographic materials for image-capturing by light-sensitive material manufactures exhibits remarkable advantages in terms of support (film base) recovery, silver recovery, and photographic solution waste treatment, and the problems mentioned above are solved. Particularly, silver which is not dissolved in processing solutions but exists in the silver halide photographic emulsion layers of photographic materials can be recovered. Accordingly, it is possible to achieve higher silver recovery efficiency and high cost reduction. Furthermore, an advantage is exhibited which enables a large reduction of cost, necessary for liquid waste treatment, such as transportation costs for photographic solution waste treatment.

We claim:

1. A method to recover resources incorporated in a photographic material which comprises:

processing an exposed silver salt light-sensitive photographic material by color development processing including a dye image-forming process but not removal of light-sensitive compositions and photographically processed material to form an image;

reading the obtained image information by optical reading means;

obtaining digital image information by converting the optically read information to electrical signals;

recording the digital image information on a recording medium; and recovering resources comprising silver and film base from processed photographic material.

2. The method of claim 1 wherein the silver salt light-sensitive photographic material is a silver halide light-sensitive photographic material.

3. The method of claim 1 wherein the color development process is a thermal photographic process.

4. The method of claim 1 wherein the step of recovering resources includes recovering silver-comprising resources from the processed photographic material.

5. The method of claim 1 wherein the step of recovering resources from processed photographic material includes a step of transportating silver-comprising resources to a silver-recovering facility without changing a configuration of image-capturing photographic materials.

6. The method of claim 1 wherein the step of recovering resources from processed photographic material includes a step of recovering silver from processed photographic materials and recycling supports of the photographic materials.

7. The method according to claim 1, wherein said recovering resources consist essentially of silver and film base.

8. A method to recover resources incorporated in a photographic material, which comprises:

processing an exposed silver halide light-sensitive photographic material by color development processing, without processing bleaching or fixing;

reading the obtained image information by optical reading means;

obtaining digital image information by converting the optically read information to electrical signals, recording the digital image information on a recording medium, and recovering resources comprising silver and film base from processed photographic material.

* * * * *